United States Patent [19]

Bale et al.

[11] Patent Number: 4,832,057

[45] Date of Patent: May 23, 1989

[54] MANUFACTURE OF A SMOKING ARTICLE

[75] Inventors: Christopher R. Bale, Bristol; Raymond A. Bryant, Yatton; Stephen J. Garrett, Lydford-on-Fosse; Beresford R. Gill, Bristol; Trevor C. Jennings, Ashton, all of United Kingdom

[73] Assignee: Imperial Tobacco, Ltd., Hartcliffe, England

[21] Appl. No.: 941,194

[22] Filed: Dec. 12, 1986

[30] Foreign Application Priority Data

| | | | |
|---|---|---|---|
| Dec. 19, 1985 | [GB] | United Kingdom | 8531338 |
| Dec. 19, 1985 | [GB] | United Kingdom | 8531339 |
| Oct. 24, 1986 | [GB] | United Kingdom | 8625478 |

[51] Int. Cl.[4] ..... A24C 5/46

[52] U.S. Cl. ..... 131/73; 131/58; 131/78; 131/85; 131/365; 131/329

[58] Field of Search ..... 131/70, 71, 58, 77, 131/78, 85, 365, 329

[56] References Cited

U.S. PATENT DOCUMENTS

| | | | |
|---|---|---|---|
| 571,778 | 11/1896 | Madden | 131/85 |
| 798,194 | 8/1905 | Lawton | 131/85 |
| 1,233,048 | 7/1917 | Goodall | 131/85 |
| 1,299,050 | 4/1919 | Southmayd | 131/85 |
| 2,427,957 | 9/1947 | Getts, Jr. | 131/71 |
| 3,927,681 | 12/1975 | Bramhill | 131/70 |

FOREIGN PATENT DOCUMENTS

| | | | |
|---|---|---|---|
| 155514 | 2/1985 | European Pat. Off. . | |
| 178605 | 12/1985 | European Pat. Off. . | |
| 3244906 | 6/1984 | Fed. Rep. of Germany . | |
| 0350368 | 1/1906 | France | 131/365 |
| 0419320 | 1/1911 | France | 131/365 |
| 427582 | 3/1911 | France . | |
| 5638/10 | of 1910 | United Kingdom . | |
| 102397 | 12/1916 | United Kingdom . | |

*Primary Examiner*—V. Millin

*Attorney, Agent, or Firm*—Larson and Taylor

[57] ABSTRACT

An apparatus for making a smokeable cigarette from a preformed inherently unsmokeable rod of tobacco and a separate sheet of cigarette paper provided with a strip of contact adhesive comprises an open-ended smooth bore resilient tube provided with a longitudinal slit defined by a pair of lips one of which is radially further spaced from the axis of the tube than is the other lip and is tangential to the circumference of the tube. In operation, the rod is inserted axially into the tube, the paper is then inserted into the slit and the rod rotated so as to wind the paper onto the rod. The user squeezes the tube so as to control the friction between the rod and the sheet. The sheet finally adheres to itself by means of the strip of adhesive. The invention also includes a booklet of cigarette papers which are mounted on the backing card by strips of contact adhesive. On removing a sheet from the card the strip of adhesive remains attached to the sheet.

21 Claims, 6 Drawing Sheets

FIG.16
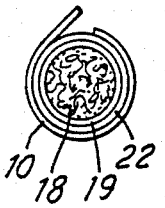
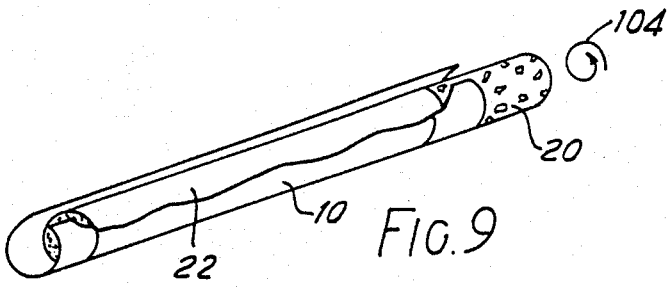
FIG.9
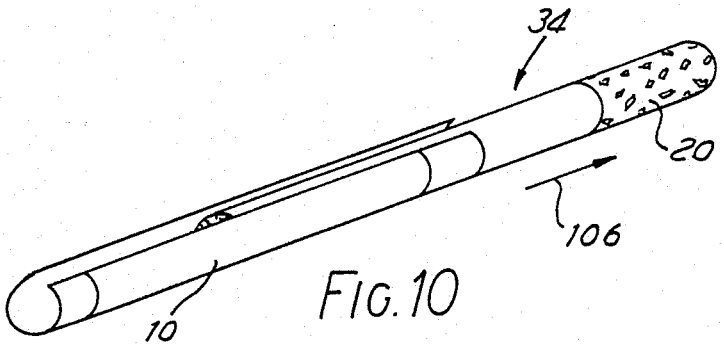
FIG.10
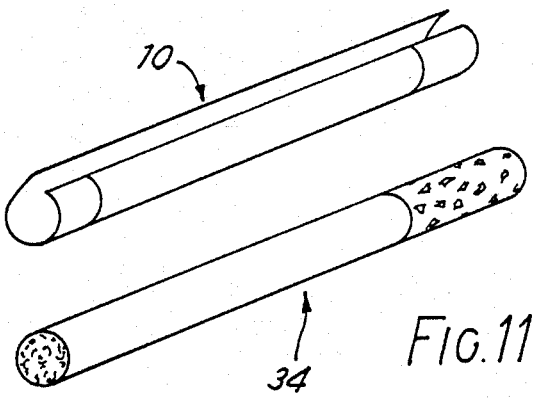
FIG.11

MANUFACTURE OF A SMOKING ARTICLE

This invention concerns improvements in or relating to the manufacture of a smoking article. In several embodiments it relates to an apparatus for and method of overwrapping with cigarette paper a preformed rod of smoking material, a smoker's kit to enable a smoker to make his own cigarettes, and a mounted arrangement of pregummed cigarette papers.

The smoking material envisaged by this invention includes tobacco, reconstituted tobacco, non-tobacco cellulosic material, or any combination thereof, and a preformed rod made therefrom is made so as to be inherently unsmokeable until it has been overwrapped.

In the prior art, hand-rolled cigarettes have commonly been prepared either by the smoker placing a string of loose tobacco on a sheet of cigarette paper and then wrapping the paper round the tobacco, or by inserting loose tobacco and cigarette paper into a mechanical device which must then be operated to make a cigarette. The smoker faces difficulties if he wishes to make a filter cigarette by these methods.

Another example of prior art is to be found in European Patent Application No. 178605A. In this document there is disclosed, (1) a preformed sheathed rod of tobacco the sheath of which has a longitudinal flap extending radially of the rod;

(2) a cigarette filter hull that is slit from its open end to the filter, one lip of the slit projecting radially from the hull; and, (3) a tube of sprung flexible material having a slit extending its length, both lips of the slit extending radially outwards of the tube.

In EPA No. 178605A the disclosure reveals that the preformed rod is inserted into the hull so that the flap projects through the slit in the hull. The combination article so made is then inserted axially into the tube, again so that the flap protrudes through the slit in the tube. By pulling outwards on the protruding flap a glueing seam and a predetermined line of weakness of the sheath are torn open. By further pulling on the flap the sheath is pulled out completely and may be thrown away. By relative rotation of the split tube in relation to the cigarette hull (which now contains the unsheathed rod of tobacco) the outwardly projecting lip of the hull is folded back inwards to overlap with the other lip of the hull and glued to it by a previously activated adhesive layer. Clearly, this procedure is complex and expensive both in its operation, the arrangement of components needed to make a cigarette, and their packaging, and is wasteful in that the sheath in which the tobacco rod is initially enclosed is thrown away.

This and other devices and methods of the prior art suffer from the disadvantages that they produce either a cigarette that is markedly inferior to a commercially-made cigarette, or else require the smoker to carry around with him and to manipulate a relatively complex and/or expensive device.

It is an object of the present invention to provide an apparatus to enable a smoker to make easily and cheaply by hand a plain or filter cigarette of a quality comparable to that produced commercially.

According to a first aspect of the present invention there is provided an apparatus for overwrapping a preformed rod of smoking material with a sheet of wrapping material, the apparatus comprising a smooth bore tube of resilient but rigid material open at at least one end adapted to receive said preformed rod of smoking material when inserted axially therein, and provided with a longitudinal slot extending parallel to the axis of the tube and adapted to receive said sheet of wrapping material, one lip of the slot being tangential to the circumference of the tube and located at a greater distance from the axis of the tube than the other lip of the slot so as to provide a guide inlet for said sheet of wrapping material when inserted in the slot, the smoothness of the bore of the tube being such that the friction between the tube and the sheet of wrapping material is less than the friction between the sheet of wrapping material and the rod, and the tube being sufficiently deformable so that the user is able to reduce by finger pressure the diameter of the tube and thereby control the friction between the rod and sheet on rotating the rod within the tube so as to enable the sheet to be taken up by the rod.

Preferably the internal diameter of the unstressed tube is less than or equal to the diameter of a rod before the rod is inserted.

Preferably the apparatus is provided with means to indicate how far the rod should be inserted into the tube. Such means may be a marking or markings on the tube.

Preferably said one lip of the slot is thickened with respect to the wall thickness of the remainder of the tube.

Preferably the tube is made from resilient plastics material or from thin resilient metal sheet.

According to a second aspect of the present invention there is provided a smoker's kit to enable a smoker to make a smokeable cigarette, the kit comprising a preformed rod of smoking material that is inherently unsmokeable until it has been overwrapped, a sheet of wrapping material provided with a line of adhesive, the sheet being adapted to be wrapped round the preformed rod, and a tube of resilient but rigid material open at at least one end adapted to receive said preformed rod of smoking material when inserted axially therein, and provided with a longitudinal slot extending parallel to the axis of the tube and adapted to receive said sheet of wrapping material, and, on manipulation by the smoker, to wrap the sheet round the preformed rod and to secure the sheet to the rod so as to make a smokeable cigarette.

The preformed rod according to either aspect preferably includes a plug of filter material in abutment with the smoking material. The plug may be joined to the rod by means of tipping paper.

The wrapping material in either aspect is preferably cigarette paper.

The line of adhesive is preferably a contact adhesive.

According to a third aspect of the present invention there is provided a mounted arrangement of individually detachable sheets of flexible material, the arrangement comprising a backing web provided with a plurality of regions of contact adhesive and a set of sheets of flexible material mounted in an imbricated array on the backing web by means of the regions of contact adhesive, the arrangement being such that on separating a sheet from the backing web the respective region of contact adhesive holding said sheet to the web is thereby detached from the backing web and retained on said sheet.

Preferably the sheets are mounted on the backing web so that corresponding edges of the sheets lie parallel to and spaced in succession from one edge of the backing web.

Preferably the backing web is coated with a release layer of a silicone plastics or wax material adapted to permit each said sheet of flexible material and a respective region of contact adhesive to be removed without significant damage to said region of contact adhesive retained on said sheet of flexible material.

Preferably the backing web is a cellulosic card or paper.

Preferably each sheet of flexible material is a sheet of cigarette paper and the regions of adhesive on the backing web are arranged so as to provide a longitudinal sealing strip on each sheet of cigarette paper when the cigarette paper is subsequently wrapped round loose tobacco or a preformed rod of smoking material.

There may be provided a booklet of mounted detachable sheets of flexible material comprising a plurality of the arrangements of the third aspect wherein each backing web is joined to another backing web along a fold line.

According to a fourth aspect of the present invention there is provided a method of making a smokeable cigarette from an inherently unsmokeable rod of smoking material and a sheet of cigarette paper provided with a strip of adhesive along one edge, the method comprising the steps of, (a) inserting the rod into a longitudinally split tube of resilient material so that the rod is a close fit in the tube,
(b) inserting an edge of the sheet of cigarette paper that is opposed to the strip of adhesive into the slot,
(c) rotating the rod axially within the tube and applying sufficient finger pressure to the tube to deform the tube so as cause the sheet of cigarette paper to be taken up by the rod as it is rotated until the adhesive strip has been drawn into the tube and adhered to the rod, and
(d) releasing the pressure on the tube and removing the completed cigarette from the tube.

Hence the present invention provides a simple apparatus and method of making a smokeable cigarette from inherently unsmokeable components without any wastage and affording the smoker the opportunity of providing a factory quality cigarette.

The invention will now be described by way of example only with reference to the accompanying non-scale diagrammatic drawings in which, FIG. 1 is an oblique perspective view of a tube for wrapping a preformed rod of smoking material;

FIGS. 5 to 11 are each an oblique view of a preformed tobacco rod and filter, a sheet of cigarette paper, and a tube according to FIGS. 1 to 3, shown partly cut away where necessary for clarity, showing successive stages in the making of a cigarette by means of the invention;

FIGS. 12 to 16 are each a cross-section through the components of FIGS. 5 to 9 respectively;

Figure 1:
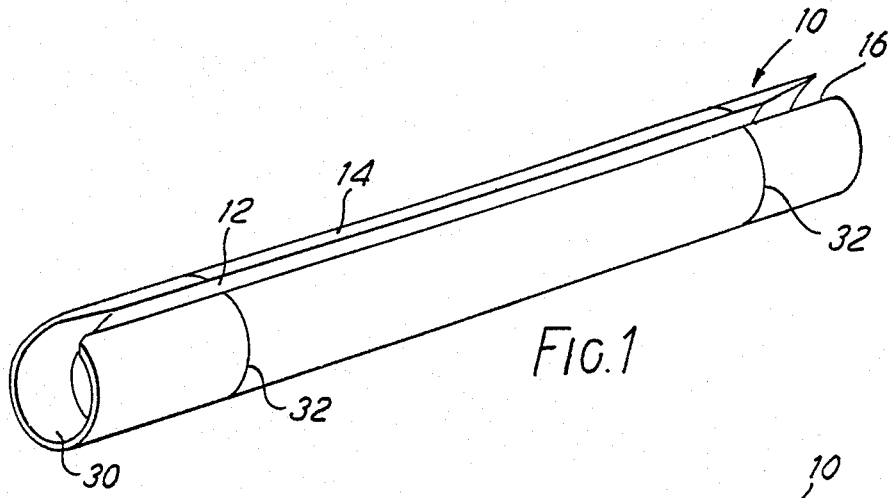
Figure 3:
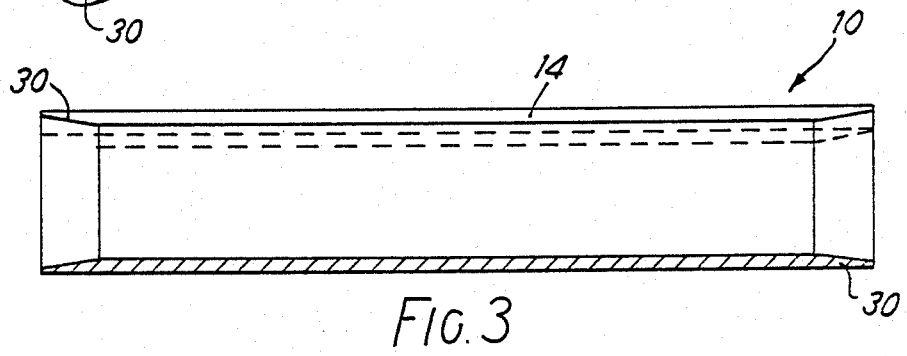
FIG. 3 is a longitudinal cross-section through the tube of FIGS. 1 and 2 taken along line III—III of FIG. 2.
Figure 2:
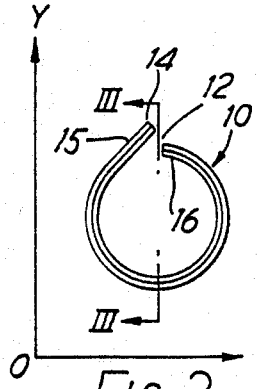
FIG. 2 is an axial end view of the tube of FIG. 1.

Referring to FIGS. 1 to 3 of the drawings there is shown an injection moulded tube 10 made of a rigid but resilient plastics material such as polyethylene or polypropylene, of substantially circular section, open at both ends and provided with a longitudinal slot 12 extending parallel to the axis of the tube from one end of the tube to the other. The tube 10 is provided with a smooth or polished inner surface.

As shown more clearly in FIG. 2, one lip 14 of the slot 12 is located at a greater radial distance from the axis of the tube than is the other, opposed lip 16, so that lip 14 (the upper lip) is raised above the lip 16 (the lower lip), thereby providing a longitudinally extending narrow slot or inlet to the tube. The upper lip 14 is connected to the remainder of the tube 10 by a tangential portion 15. Referring especially to FIG. 2 wherein lines OX and OY are to be interpreted as horizontal and vertical directions respectively, the horizontal distance between the edges of the lips 14,16 is in the range 0 to 2.0 mm and the vertical distance between the lips is in the range 0.5 to 1.0 mm.

Figure 4:
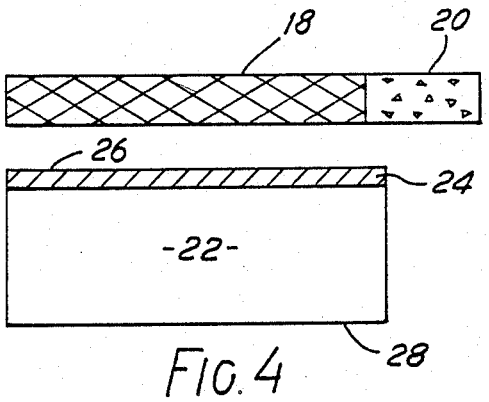
FIG. 4 is a side view of a preformed tobacco rod and filter, together with a plan view of a pregummed sheet of cigarette paper, showing the relative dimensions of the rod and sheet, for use with the tube of FIGS. 1 to 3.

FIG. 4 shows a preformed tobacco rod 18 with an attached filter plug 20. The rod 18 with attached filter plug 20 is not at this stage wrapped with cigarette paper, and is characterised in that it is inherently unsmokeable until it has been overwrapped or further wrapped in a sheet of wrapping material which is preferably but not necessarily a combustible cellulosic material such as cigarette paper.

FIG. 4 also shows a pregummed sheet of cigarette paper 22 provided with a gum line 24 along an edge 26. The sheet of cigarette paper 22 is cut to a size such that it is capable of enwrapping the rod 18 and a short length (e.g. 2 mm) of the attached filter plug 20, the gum line 24 on edge 26 overlapping edge 28 opposed to edge 26 when wrapped round the rod 18.

The preformed rod of smoking material is made of a smoking material such as any tobacco (cigarette, cigar, pipe or hand-rolling) intended for smoking that is contained within a first wrapper or formed in such a way that it is inherently incapable of being smoked until it has been overwrapped. Such a preformed rod may be provided in a number of ways.

For example, smoking tobacco (which may be cut or threshed by methods known in the art) is wrapped in a highly porous open structured paper such as teabag tissue. The product so formed is inherently unsmokable until it has been overwrapped in cigarette paper.

Teabag tissue is a coarse woven cellulosic web consisting of a pattern of thin areas, which in this context we shall refer to as "apertures". Typically, a teabag tissue may have about 25 "apertures" in a rectangular or diamond-shaped array per square centimeter, each "aperture" having dimensions of about 1 mm×1 mm. The typical thickness of a teabag tissue "aperture" is 1 fibre, the regions of the web separating the "apertures" being several fibres thick. The teabag tissue may be strengthened by means of strips or strings of strengthening materials such as cotton, plastics, or impermeable paper, or may be replaced by any of the following:

(a) Impermeable or permeable paper that has been heavily mechanically perforated;

(b) Tobacco sheet formed by known processes that has been heavily mechanically perforated;

(c) Plastics (e.g. polyolefine) or natural fibre (e.g. cotton) net; or, (d) A film of adhesive.

Alternatively, the smoking material may be moulded, pressed, pelleted or extruded with carboxymethyl cellulose or starch to form a self-supporting rod that is inherently unsmokeable until it has been overwrapped.

Yet again, the product may be formed on a cigarette making machine by applying a hot melt adhesive to the smoking material and then passing the smoking material through a hot garniture to set the adhesive. Again, the product is inherently unsmokeable until it has been overwrapped.

The dimensions of the tube 10 are such that it can receive the preformed rod 18 with filter plug 20 attached. The tube dimensions will depend on the size of the rod 18 that is to be inserted into the tube 10, but typical ranges of the dimensions that are contemplated are:

(i) tube length: 45 to 110 mm;

(ii) wall thickness of tube (in the unchamfered region): 0.3 to 1.0 mm, typically 0.5 mm for a tube made of polypropylene;

(iii) internal diameter of unstressed tube: 0.1 mm less than the diameter of a preformed rod with a diameter in the range 7.5 to 8 mm.

The purpose of the internal diameter of the unstressed tube 10 being slightly less than the diameter of the preformed rod 18 before the rod is inserted into the tube is to ensure that the rod is an interference fit in the tube. The tube 10, being resilient, will expand circumferentially to accommodate the rod 18, and the rod will be slightly compressed by the opposing resilience of the tube. Clearly, for ease of insertion of the rod 18 into the tube 10 with an interference fit without risking damage to the rod it is essential that the internal surface or bore of the tube be smooth or even polished so as to offer minimal frictional obstruction to the rod. Insertion of the rod 18 into the tube 10 is further assisted by providing the wall thickness of the tube with chamfers 30 at each end of the tube, as shown.

The tube 10, as shown in FIGS. 1 and 5 to 11, is further provided with circumferential markings 32 equispaced from either end to indicate how far the rod 18 should be inserted in the tube. The symmetry of the tube 10 about its midpoint enable the chamfers 30 and circumferential markings 32 to the utilised no matter into which end of the tube the rod 18 is inserted.

The operation of the preferred embodiment will now be described with reference to FIGS. 5 to 16.

Figure 12:
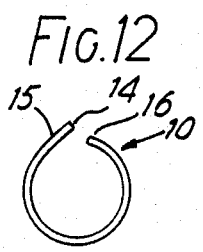
Figure 5:
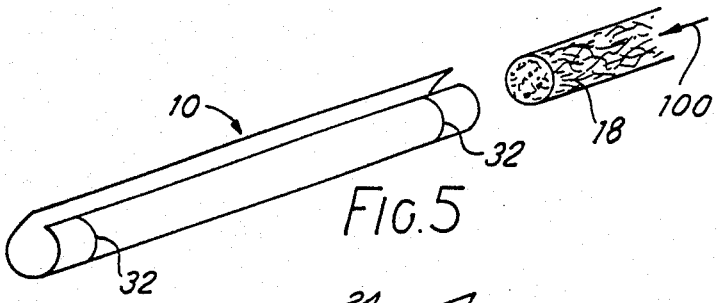

FIG. 5 shows a preformed tobacco rod 18 with filter 20 attached (the filter not being visible in FIG. 5) being presented in the direction of arrow 100 to the proximal end of an appropriately sized tube 10 as described with reference to FIGS. 1 to 3. FIG. 12 is a cross-section through the tube 10 before the rod 18 is inserted.

Figure 13:
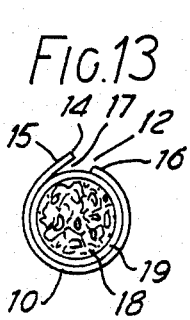
Figure 6:
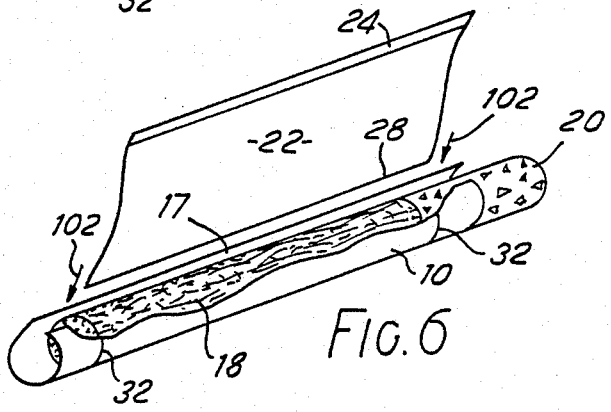
Figure 14:
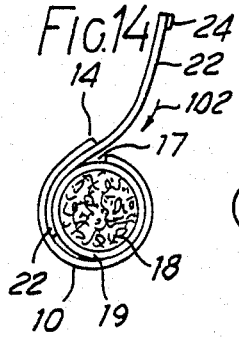
Figure 7:
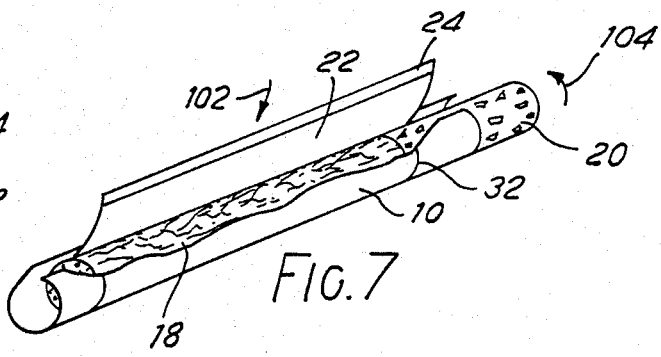
Figure 15:
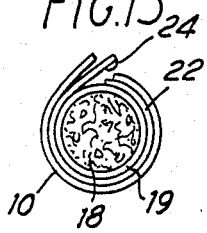
Figure 8:
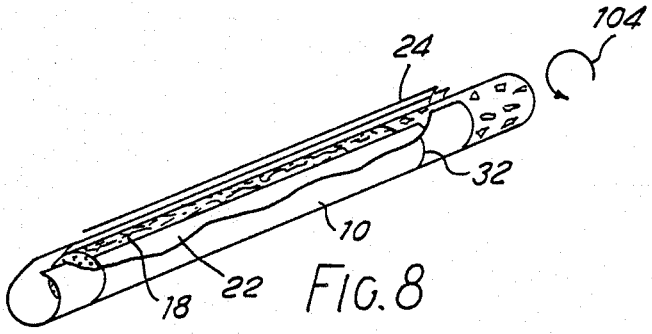

FIGS. 6 and 13 show the rod 18 inserted into the tube 10 so that the filter plug 20 projects 1–1.5 cm from the end of the tube. This is achieved by moving the rod 18 so that its inserted end is in alignment with the distal circumferential marking 32 and a portion of the filter 20 projects beyond the proximal end of the tube. The chamfered wall thickness 30 at the ends of the tube 10 enable this insertion to be performed easily without risk of damage to the preformed rod 18.

FIG. 6 further shows a sheet of cigarette paper 22 provided with a strip 24 of contact adhesive being presented squarely (edge 28 leading) to the slot 12, in the direction of arrows 102. FIG. 13 shows the rod 18 within the tube 10, the rod being already wrapped in a layer of teabag tissue 19.

FIGS. 7, 14, 8 and 15 show the sheet of cigarette paper 22 being inserted into the tangential nip 17 defined by the tobacco rod 18 and the raised lip 14 of the slot 12. The resilience of the tube 10 permits the tube circumference to expand sufficiently to accept the insertion of the sheet of cigarette paper 22, despite the closeness of fit of the rod 18 within the tube. Again, it is necessary for the inner surface of the tube 10 to be smooth in order for the insertion of the cigarette paper to be effected.

By applying gentle finger pressure to the tube 10 so that its tangential wall 15 deforms and bends slightly radially inwards against its resilience to press the leading edge of the cigarette paper 22 against the rod 18, thereby preventing any slipping between the two, and simultaneously rotating the filter/tobacco rod assembly about its axis in the direction of arrow 104 by means of the projecting portion of the filter plug 20, the paper 22 is wrapped tightly round the tobacco rod and 2–3 mm length of the attached filter plug.

It is essential that the smoothness of the bore of the tube be such that the friction between the bore and the sheet of cigarette paper (or other wrapping material) 22 is less than the friction between the cigarette paper and the rod 18 when the rod is rotated, otherwise it will not be possible for the cigarette paper to be taken up by the rod.

Further and final rotation of the rod 18 as shown in FIGS. 9 and 16 ensures that the strip 24 of contact adhesive secures the cigarette paper 22 against itself thus maintaining the paper in contact with the rod and filter plug 20. The sealing of the rod by the cigarette paper is materially assisted by the tangential configuration 15 of the upper lip 14 with respect to the wall 12 of the tube.

The overwrapped rod 18 together with filter plug 20 now form a smokeable cigarette 34. The user then releases the finger pressure on the tube 10 and pulls the cigarette 34 from the tube 10 in the direction of arrow 106 (FIGS. 10, 11).

The invention thus provides a means of easily making with simple apparatus and a minimum of skill a handmade cigarette comprising a neat and tightly overwrapped tobacco rod and filter with the minimum of leaks between the cigarette paper and rod and can provide a smoking experience similar to that provided by machine-made commercial cigarettes, and superior to that provided by hand-rolled cigarettes made in the traditional manner.

It is further necessary to have the tube 10 made of resilient material such as an injection moulded polymer to accommodate inevitable minor mis-matching of the diameter of a rod with the diameter of the tube and to enable the user to control by a minimum and easily acquired amount of skill the pressure needed to wrap the cigarette paper round the rod sufficiently tightly so as to eliminate air leaks between the paper and the rod or the paper and the filter plug when the cigarette is smoked.

If the tolerance between the diameter of the tube and the diameter of the rod is too slack it will not be possible to obtain the necessary friction for the rod to take up the sheet of cigarette paper when it is fed in. Conversely, if the tolerance is too tight then it may be too difficult to insert the rod into the tube without damaging the rod or to leave enough room for the cigarette paper to be taken up. It is accordingly preferred that the internal diameter of the tube 10 is either equal to or slightly less than the diameter of a rod 18 to be inserted. However, it may be envisaged that a rod may be very slightly less in diameter than the internal diameter of the tube, but in that case it will be necessary to ensure that the tube can be squeezed tightly enough to ensure that the rod is adequately wrapped by the sheet of cigarette paper.

A further aspect of the present invention also provides the overwrapping cigarette paper in a convenient arrangement.

It is common practice for a smoker who rolls his own cigarettes for the smoker to take a sheet of cigarette paper from a packet and wrap loose tobacco or other smoking material in the sheet, either manually or with the assistance of one of a variety of manually operated mechanical devices that are on the market. The smoker will then seal the cigarette paper along a longitudinal edge by the application of his saliva or, in the case of certain of the manually operated devices, by the application of an adhesive.

The application of an adhesive from a device can be inconvenient in that a reservoir of adhesive is usually required, and such a reservoir can be liable to leakage, evaporation and drying up, or insufficiency of adhesive. The application of saliva can likewise be inconvenient and, on occasion, socially undesirable.

The present invention overcomes these inconveniences and enables a set of pregummed cigarette papers to be stored as a set without one cigarette paper adhering to another, and will now be described with reference to FIGS. 17 to 23 of the drawings.

Figure 18:
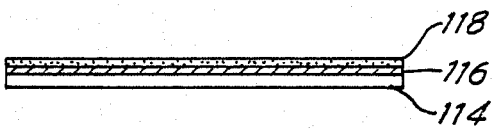
FIG. 18 is a cross-section through the backing web of FIG. 17 taken along line XVIII—XVIII.
Figure 17:
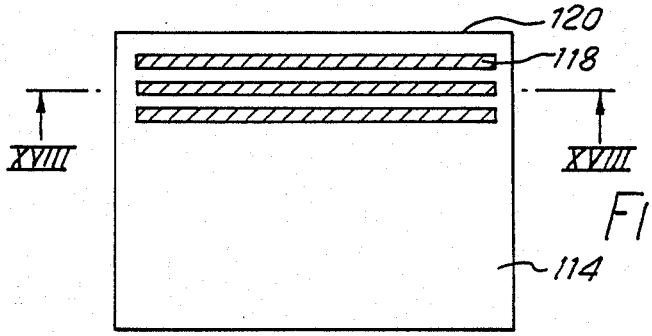
FIG. 17 is a plan view of a backing web having applied strips of adhesive before sheets of cigarette paper have been attached to it.

As shown in FIG. 17 and FIG. 18 which is a cross section through FIG. 17, a cellulosic card 114 is coated with a layer of silicone plastics release material 116 on which is printed or otherwise applied (e.g. by rolling) spaced strips 118 of contact adhesive. The strips 118 lie parallel to a top edge 120 of the card 114. A suitable plastics release material may be a polyethylene based polymer with a silicone additive, or may be a natural wax or lacquer, and the adhesive may be based on polyvinyl acetate.

Figure 19:
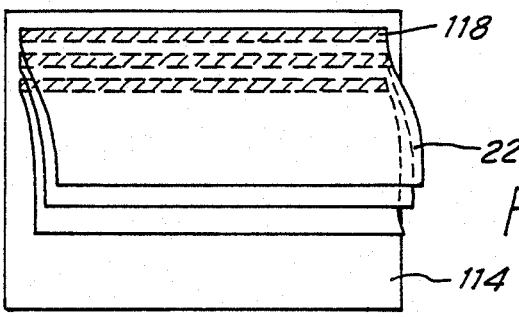
FIG. 19 shows the backing web of FIG. 17 with a number of sheets of cigarette paper attached thereto.
Figure 20:
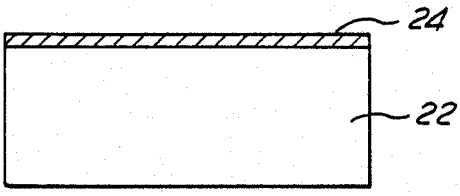
FIG. 20 is a plan view of a sheet of cigarette paper when separated from the backing web of FIG. 19.

FIG. 19 shows a number of sheets 22 of cigarette paper, such as are commonly used for wrapping loose tobacco or a preformed rod of smoking material to form a cigarette, applied to the card 114 so that each sheet adheres to the card by means of a respective strip 118 of contact adhesive. The arrangement of the sheets 22 on the card 114 is such that the sheets lie in an imbricated array; that is, each sheet is separately attached to the card only by means of its individual strip of adhesive 118 and the sheets overlap each other in the manner of roof tiles. Hence, the strips of adhesive 118 do not cause the sheets 22 to adhere to one another.

The coating 116 of the card 114 is chosen such that the adhesive strips 118 adhere to the coating but each sheet 22 of cigarette paper can nevertheless be peeled off the card taking a strip 118 of contact adhesive with it and without either leaving adhesive on the card, disturbing other sheets, or significantly damaging the strip of adhesive.

The strips of adhesive 118 are positioned on the card 114 so that when a sheet 22 of cigarette paper has been peeled off the card, taking a strip of contact adhesive with it, the contact adhesive now on the cigarette paper sheet as strip 24 (see FIGS. 4, 7, 14, 20) enables opposed edges of the sheet to adhere to each other when the sheet is subsequently wrapped round tobacco or a preformed rod of smoking material, as described above.

Figure 21:
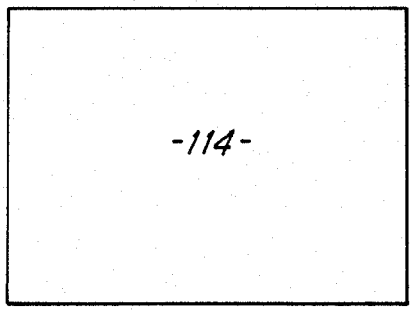
FIG. 21 is a plan view of the backing web of FIG. 19 after all the sheets of cigarette paper have been removed.

When all the sheets 22 have been separated from the card 114 the card 114 is now without adhesive strips. This is illustrated in FIG. 21 which shows the card 114 of FIGS. 17 and 18 with the adhesive strips 118 removed.

Figure 22:
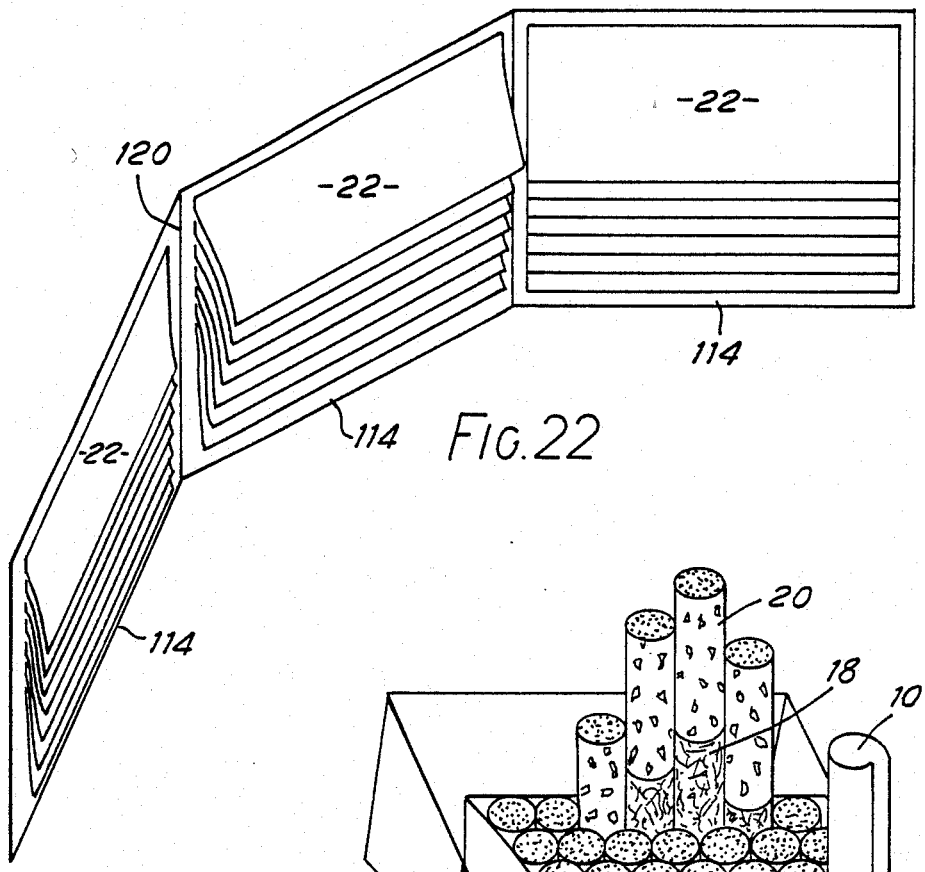
FIG. 22 is an oblique view of a book of cigarette papers according to the invention; and, FIG. 23 is an oblique view of a kit of parts according to the invention.

FIG. 22 shows a set of individual cards 114, each with a plurality of attached sheets 22 of cigarette paper, joined together by common fold lines 120, so that the cards may be folded over each other to form a booklet 128. Such a booklet 128 may be provided on one or more of its uncoated faces with instructions, advertising, or other printed matter.

Figure 23:
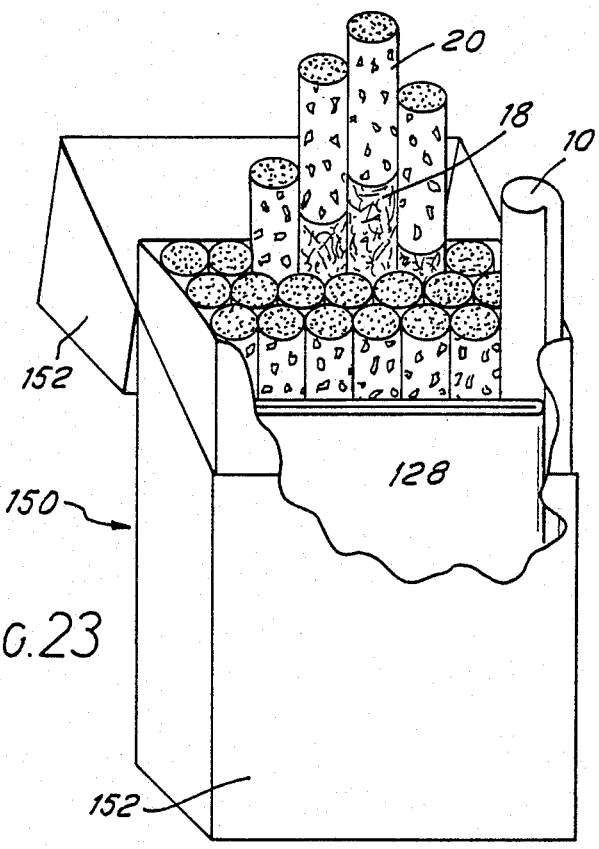

FIG. 23 shows a smoker's kit 150 comprising a flip-top carton 152, shown partly cut away, enclosing a plurality of inherently unsmokeable rods 18 of smoking material, each rod having a filter plug 20 attached, as described with reference to FIG. 4, a booklet 128 of cigarette papers 22, as described with reference to FIGS. 17 to 22, and a tube 10, as described with reference to FIGS. 1 to 3, for enabling a user to assemble smokeable cigarettes from the unsmokeable rods 18 and the cigarette papers.

The filter plug may be attached to the rod of smoking material in a manner other than solely by means of tipping paper. One such alternative method of attachment is described in British Patent Application No. 2164237A in which a filter plug is attached to a tobacco rod principally by means of discrete regions of adhesive about 1 mm in diameter located in the abutment between the plug and the rod.

Although the invention has been described with reference to an inherently unsmokeable rod of smoking material having an attached filter plug at one end it may, in an alternative embodiment, encompass a smoking product comprising an inherently unsmokeable rod of smoking material without an attached filter plug. In this case a portion of the rod of a sufficient length to be manipulated by the user would project beyond the end of the tube 10 and would consequently not be wrapped by the cigarette paper. A wrapped rod having a projecting portion of inherently unsmokeable rod could be utilised by the smoker in a number of different ways, three of which are adumbrated as follows.

(1) The unwrapped end of the wrapped cigarette could be inserted into a cigarette holder or a filter device.

(2) The projecting unwrapped portion could be cut off so that the resulting cigarette could be smoked as a filterless cigarette.

(3) The projecting unwrapped portion, if sufficiently short and made of an appropriate smoking material, could even be lit by the smoker and maintained alight by drawing on the cigarette so that after one or two draws the unwrapped portion becomes consumed and normal shoulder and smoking of the cigarette thereafter takes place.

In yet a further embodiment the wrapping material may be an incombustible material such as very thin aluminium foil, or a laminate of an incombustible material with cigarette paper.

The wrapping material may be provided with ventilation holes if required.

In other embodiments the tube 10 may be made of a material other than a resilient plastics sheet, such as spring steel or brass shim.

The tube 10 may also be provided on its outer surface with moulded or otherwise formed projections or patterns to enable the smoker to grip and manipulate the tube more easily.

The raised lip 14 of the tube 10 may be thickened or otherwise shaped to provide strength.

In yet a further embodiment the cigarette paper may be provided with a gum line adapted to be moistened by the user. Such cigarette papers are known in the art. In this case, the cigarette paper is fed into the slot 12 as described above and wrapped round the rod until about 5 mm of cigarette paper including the gum line is protruding from the slot. The user now moistens the gum line and the rotation of the rod is resumed to complete the overwrapping.

Alternative means for indicating how far a rod should be inserted into the tube 10 may be provided by a projection or boss on the inside of the tube, or by a closure member at an end of the tube, but this would destroy the symmetry of the tube of the preferred embodiment whereby a rod may be inserted from either end.

We claim:

1. An apparatus for overwrapping a preformed rod of smoking material with a sheet of wrapping material, the apparatus comprising a smooth bore tube of resilient but rigid material open at at least one end adapted to receive said preformed rod of smoking material when inserted axially therein, and provided with a longitudinal slot extending parallel to the axis of the tube and adapted to receive said sheet of wrapping material, one lip of the slot being tangential to the circumference of the tube and located at a greater distance from the axis of the tube than the other lip of the slot so as to provide a guide inlet for said sheet of wrapping material when inserted in the slot, the smoothness of the bore of the tube being such that the friction between the tube and the sheet of wrapping material is less than the friction between the sheet of wrapping material and the rod, and the tube being sufficiently deformable so that the user is able to reduce by finger pressure the diameter of the tube and thereby control the friction between the rod and sheet on rotating the rod within the tube so as to enable the sheet to be taken up by the rod.

2. Apparatus as claimed in claim 1 wherein the internal diameter of the unstressed tube is less than or equal to the diameter of a rod before the rod is inserted.

3. Apparatus as claimed in claim 1 provided with means to indicate how far the rod should be inserted into the tube.

4. Apparatus as claimed in claim 3 wherein the means comprises a marking or markings on the tube.

5. Apparatus as claimed in claim 1 wherein said one lip of the slot is thickened with respect to the wall thickness of the remainder of the tube.

6. Apparatus as claimed in claim 1 wherein the tube is made from resilient plastics material or from thin resilient metal sheet.

7. Apparatus as claimed in claim 1 wherein the wrapping material is cigarette paper.

8. Apparatus as claimed in claim 1 wherein the preformed rod includes a plug of filter material in abutment with the smoking material.

9. Apparatus as claimed in claim 1 wherein the plug is joined to the rod by means of tipping paper.

10. A smoker's kit to enable a smoker to make a smokeable cigarette, the kit comprising a self-supported preformed rod of smoking material that is inherently unsmokeable until it has been overwrapped, a sheet of wrapping material provided with a line of adhesive, the sheet being adapted to be wrapped round the preformed rod, and a tube of resilient but rigid material open at at least one end adapted to receive said preformed rod of smoking material when inserted axially therein, and provided with a longitudinal slot extending parallel to the axis of the tube and adapted to receive said sheet of wrapping material, and, on manipulation by the smoker, to wrap the sheet round the preformed rod and to secure the sheet to the rod so as to make a smokeable cigarette.

11. A kit as claimed in claim 10 wherein the wrapping material is cigarette paper.

12. A kit as claimed in claim 10 wherein the preformed rod includes a plug of filter material in abutment with the smoking material.

13. A kit as claimed in claim 10 wherein the plug is joined to the rod by means of tipping paper.

14. A kit as claimed in claim 10 wherein the line of adhesive is a contact adhesive.

15. A mounted arrangement of individually detachable sheets of flexible material, the arrangement comprising a backing web provided with a plurality of regions of contact adhesive and a set of sheets of flexible material mounted in an imbricated array on the backing web by means of the regions of contact adhesive, the arrangement being such that on separating a sheet from the backing web the respective region of contact adhesive holding said sheet to the web is thereby detached from the backing web and retained on said sheet.

16. An arrangement as claimed in claim 15 wherein the sheets are mounted on the backing web so that corresponding edges of the sheets lie parallel to and spaced in succession from one edge of the backing web.

17. An arrangement as claimed in claim 15 wherein the backing web is coated with a release layer of a silicone plastics or wax material adapted to permit each said sheet of flexible material and a respective region of contact adhesive to be removed without significant damage to said region of contact adhesive retained on said sheet of flexible material.

18. An arrangement as claimed in claim 15 wherein the backing web is a cellulosic card or paper.

19. An arrangement as claimed in claim 15 wherein each sheet of flexible material is a sheet of cigarette paper and the regions of adhesive on the backing web are arranged so as to provide a longitudinal sealing strip on each sheet of cigarette paper when the cigarette paper is subsequently wrapped round loose tobacco or a preformed rod of smoking material.

20. A booklet of mounted detachable sheets of flexible material comprising a plurality of the arrangements as claimed in claim 15 wherein each backing web is joined to another backing web along a fold line.

21. A method of making a smokeable cigarette from an inherently unsmokeable rod of smoking material and a sheet of cigarette paper provided with a strip of adhesive along one edge, the method comprising the steps of, (a) providing a tube of rigid but resilient material of substantially circular cross-section, open at both ends and provided with a longitudinal slot parallel to the axis of the tube from one end of the tube to the other (b) inserting the rod into one end of the tube so that the rod is a close fit in the tube, (c) inserting into the slot an edge of the sheet of cigarette paper which is the opposite edge to said one edge provided with the strip of adhesive, (d) rotating the rod axially within the tube and applying sufficient finger pressure to the tube to deform the tube so as to cause the sheet of cigarette paper to be taken up by the rod as it is rotated until the adhesive strip has been drawn into the tube and adhered to the rod, and (e) releasing the pressure on the tube and removing the completed cigarette from the tube.

* * * * *